US005828169A

United States Patent [19]

Myojo et al.

[11] Patent Number: 5,828,169

[45] Date of Patent: Oct. 27, 1998

[54] DISCHARGE LAMP HAVING AN AMALGAM WITHIN A BARRIER MEANS

[75] Inventors: Minoru Myojo; Toshiyuki Namura, both of Takatsuki, Japan

[73] Assignee: Matsushita Electronics Corporation, Osaka, Japan

[21] Appl. No.: 652,909

[22] Filed: May 23, 1996

[51] Int. Cl.[6] ..... H01J 1/62

[52] U.S. Cl. ..... 313/475; 313/550; 313/562

[58] Field of Search ..... 313/485, 490, 313/545, 546, 550, 562, 564, 565, 560

[56] References Cited

U.S. PATENT DOCUMENTS

| | | | |
|---|---|---|---|
| 3,913,999 | 10/1975 | Clarke | 313/546 |
| 4,020,378 | 4/1977 | Morehead | 313/490 |
| 5,006,755 | 4/1991 | Wittmann et al. | 313/490 |
| 5,055,738 | 10/1991 | Yorifuji et al. | 313/490 |
| 5,204,584 | 4/1993 | Ikeda et al. | 313/490 |
| 5,294,867 | 3/1994 | Grossman | 313/490 |
| 5,412,289 | 5/1995 | Thomas et al. | 313/490 |

FOREIGN PATENT DOCUMENTS

| | | |
|---|---|---|
| 0 568 317 A1 | 11/1993 | European Pat. Off. . |
| 0 646 942 A1 | 4/1995 | European Pat. Off. . |
| 60-154451 A | 8/1985 | Japan . |
| 60-202652 | 10/1985 | Japan . |
| 62-064044 | 3/1987 | Japan . |
| WO 93/11557 | 6/1993 | WIPO . |
| WO 93/18542 | 9/1993 | WIPO . |

OTHER PUBLICATIONS

Journal of IES, Apr. 1997, pp: 141–147, "Some New Mercury Alloys For Use In Flurorescent Lamps", J. Bloem, A Bouwknegt and G.A. Wesselink.

*Primary Examiner*—Sandra L. O'Shea
*Assistant Examiner*—Vip Patel
*Attorney, Agent, or Firm*—Morrison & Foerster LLP

[57] ABSTRACT

In a fluorescent lamp with amalgam, a surface of the amalgam is covered by a barrier having at least one opening through which mercury atoms can move to a discharge space of the lamp from the amalgam while the lamp is being lighted. When the lamp is switched off, the barrier restricts the return of the mercury atoms from the discharge space to the amalgam. The amalgam solidifies faster than all the mercury atoms return to the amalgam, so that a lot of mercury atoms remain in the discharge space. When the lamp is re-lighted, an initial mercury vapor pressure can be maintained. Thus, the lamp illuminates at a predetermined intensity of the luminance from the beginning of the re-lighting.

26 Claims, 11 Drawing Sheets

DISCHARGE LAMP HAVING AN AMALGAM WITHIN A BARRIER MEANS

FIELD OF THE INVENTION

This invention relates to a low pressure mercury vapor filled discharge lamp with amalgam, and especially relates to a compact self-ballasted fluorescent lamp in which a glass tube is multiply bent and covered by a globe cover.

DESCRIPTION OF THE PRIOR ART

The compact self-ballasted fluorescent lamp is supposed to replace the conventional incandescent lamp. In the compact self-ballasted fluorescent lamp (hereinafter, referred to as fluorescent lamp), the glass tube is multiply bent, such as in a U-shape, for increasing the length of the tube (hereinafter, the tube is called multi-U-bent tube). The multi-U-bent tube is covered by the globe cover in order to imitate the shape of a conventional incandescent lamp. Thus, mercury vapor pressure in the multi-U-bent tube is more easily be affected by heat than is a straight type tube while the fluorescent lamp is lighted.

In order to solve this problem, a first type of conventional fluorescent lamp is proposed in, for example, the publication gazette of Japanese unexamined patent application Sho 62-64044. In this first type of conventional fluorescent lamp, the mercury vapor pressure in a discharge space in the multi-U-bent tube is maintained in a preferable range with an amalgam. FIG. 8 is a partially cross-sectional side view of the multi-U-bent tube of the first conventional fluorescent lamp.

As can be seen from FIG. 8, the first type of conventional fluorescent lamp comprises a main amalgam 1 and an auxiliary amalgam 8. The main amalgam 1 mainly controls the mercury vapor pressure in the predetermined range while the fluorescent lamp is lighted. The auxiliary amalgam 8 makes the evaporation of the mercury easy at the beginning of the lighting of the fluorescent lamp. Thus, the luminance of the first type of conventional fluorescent lamp is maintained at a substantially constant level from the beginning to the end of the lighting.

The main amalgam 1 is disposed at a predetermined position in a narrow tube 4 in the vicinity of an electrode 7 at an end of the multi-U-bent tube 6. The auxiliary amalgam 8 is disposed in the vicinity of an electrode 7 so that it is directly exposed to a discharge space 6*a*. When the first type of conventional fluorescent lamp is switched off, the auxiliary amalgam 8 absorbs some mercury atoms from the main amalgam 1 through the discharge space 6*a* because the mercury vapor pressure of the auxiliary amalgam 8 is lower than that of the main amalgam 1 at the same temperature.

On the other hand, since the self-ballasted fluorescent lamp replaces the conventional incandescent lamp, the mounting direction of the fluorescent lamp at the position of the fluorescent lamp is variable. Thus, the temperature at the position of the amalgam in the multi-U-bent tube changes significantly corresponding to the mounting direction of the fluorescent lamp. Consequently, it is difficult to control the the mercury vapor pressure in a predetermined range from the beginning to the end of the lighting.

In order to solve this problem, a second type of conventional fluorescent lamp is proposed in, for example, the publication gazette of Japanese unexamined patent application Sho 60-202652. FIG. 9 is a partially cross-sectional side view of the multi-U-bent tube of this second type of conventional fluorescent lamp, and FIG. 10 is an enlarged cross-sectional side view showing the detailed configuration of container 10 shown in FIG. 9. As can be seen from FIGS. 9 and 10, a main amalgam 1 is contained in a movable container 10 and the container 10 freely moves in the multi-U-bent tube 6 of the second type of conventional fluorescent lamp. Thus, the main amalgam 1 contained in the container 10 is always disposed substantially at the lowest position in the multi-U-bent tube 6 against the direction of gravity without relation to the mounting direction of the second conventional fluorescent lamp. An auxiliary amalgam 8 is disposed in the vicinity of an electrode 7 where the temperature is higher than that of the main amalgam 1, while the lamp is lighted. When the second conventional fluorescent lamp is switched off, the auxiliary amalgam 8 absorbs the mercury atoms in the discharge space 6*a*. When the second conventional fluorescent lamp is switched on, the auxiliary amalgam 8 releases the mercury atoms at the beginning of the lighting.

In the above-mentioned first and second type of conventional fluorescent lamps, a copper-iron ballast circuit including a glow discharge tube is mainly used. At the beginning of the lighting, the auxiliary amalgam 8 is heated by pre-heating of a filament while the glow discharge tube operates, so that the mercury is released from the auxiliary amalgam 8. When the mercury is released from the auxiliary amalgam 8, the mercury vapor pressure in the discharge space 6*a* of the multi-U-bent tube 6 quickly increases. Thus, the time for increasing the luminance of the conventional fluorescent lamp to a predetermined value from the start of the lighting can be shortened. (With respect to the principle of the amalgam, please see Journal of IES/APRIL 1977, pp. 141 to 147.)

In recent years, the compact self-ballasted fluorescent lamps are required to light instantly, similar to the case of the incandescent lamp. Thus, an electronic ballast circuit, which ignites the fluorescent lamp instantly, is widely used instead of the conventional copper-iron ballast circuit. When the electronic ballast circuit is used in the conventional fluorescent lamp, the time for pre-heating the filament is too short to heat the auxiliary amalgam 8 to release the mercury atoms. The amount of the mercury atoms released from the auxiliary amalgam 8 due to the heat of the filament is too small. Thus, it is difficult to maintain the mercury vapor pressure at the beginning of the lighting over a predetermined value. The time for increasing the luminance of the lamp to the predetermined value from the start of the lighting becomes longer.

On the other hand, in the second type of conventional fluorescent lamp, the main amalgam 1 is contained in the container 10 and most of the surface of the amalgam 1 is exposed to the discharge space 6*a* through an opening 10*a* of the container 10. The opening 10*a* of the container 10 permits the mercury atoms in the discharge space 6*a* to return to the main amalgam 1 in the container 10 because the surface of the main amalgam 1 is larger enough to absorb a lot of mercury atoms after switching off of the second type of conventional fluorescent lamp. The auxiliary amalgam 8 is also introduced to absorb the mercury atoms easily much better than the main amalgam 1. Thus, the mercury vapor pressure in the discharge space 6*a* at the beginning of the re-lighting of the second type of conventional fluorescent lamp cannot be maintained larger than the predetermined value in case of the combination with the instant start type electronic ballast circuit.

SUMMARY OF THE INVENTION

An objective of this invention is to provide an improved low pressure mercury vapor filled discharge lamp including a compact self-ballasted fluorescent lamp with electrodes and an electrodeless fluorescent lamp, in which the mercury vapor pressure in a discharge space can be maintained in a preferable range from the beginning of the lighting of the lamp, and a time to reach the luminance of the lamp to a predetermined value after switching on the lamp can be shortened.

A low pressure mercury vapor filled discharge lamp of this invention includes: a vessel having a fluorescent layer coated on an inner surface thereof; an amalgam including mercury and disposed at a predetermined position in a discharge space formed inside the vessel; and a barrier member for restricting movement of mercury atoms between the amalgam and the discharge space corresponding to switching on and off of the lamp. The barrier member is provided to contact the amalgam for shielding the amalgam from the discharge space except for at least one opening. The opening of the barrier member permits supply of mercury atoms from the amalgam to the discharge space while the lamp is lighted, and keeps the mercury atoms from returning to the amalgam from the discharge space while the amalgam solidifies after the switching off of the lamp.

In the above-mentioned configuration, any other type of amalgam such as an auxiliary amalgam besides above-mentioned amalgam system is not introduced. When the low pressure mercury vapor filled discharge lamp is lighted, the amalgam is changed to the liquid phase from the solid phase by heat from a filament, or the like. The mercury atoms spent in the discharge space can be supplied from the amalgam through the opening of the barrier member. Thus, the luminance of the lamp can be maintained while the lamp is lighted. When the lamp is switched off, the mercury atoms spread in the discharge space start to return to the amalgam. However, the barrier member restricts the return of the mercury atoms to the amalgam from the discharge space. Only a part of the mercury atoms spread in the discharge space can be returned to the amalgam while the amalgam solidifies, since the opening of the barrier member is too small to permit all the mercury atoms which should be back to normal type amalgam to return to the amalgam. Most of the mercury atoms spread in the discharge space remain as they are. Thus, the mercury vapor pressure in the discharge space at the beginning of re-lighting of the lamp is maintained at a value larger than a predetermined value. The time to reach the luminance of the Lamp to the predetermined value from the beginning of the re-lighting of the lamp becomes shorter, so that a sufficient luminance can be obtained at the beginning of the re-lighting of the lamp. The mercury atoms spent in the discharge space in the lighting can be supplied from the amalgam, so that the mercury vapor pressure in the discharge space can be maintained in a predetermined range while the lamp is lighted. Consequently, a predetermined luminance can be obtained from the beginning to the end of the lighting of the lamp.

In the above-mentioned low pressure mercury vapor filled discharge lamp of this invention, it is preferable that the barrier member is a container having only one opening, and the diameter of effective part of the opening is larger than the diameter of the mercury atom but smaller than 0.5 mm when the area of the opening is converted to the diameter of a circle having the same area. Also, almost of the surface of the amalgam contacts the barrier member except the opening. By such a configuration, the mercury atoms returning to the amalgam are concentrated at a predetermined portion of the surface of the amalgam facing the opening of the container serving as the barrier member. Thus, the returning speed of the mercury atoms to the amalgam becomes slower. In the meantime, the temperature of the lamp becomes lower than the solidification temperature of the amalgam before the mercury atoms in the discharge space return to the amalgam. Thus, it becomes difficult that the mercury atoms on the amalgam facing the opening of the container diffuse into the amalgam, and they remain on the surface of the amalgam. Consequently, a lot of mercury atoms remain in the discharge space.

Furthermore, it is preferable that the container is disposed in the vicinity of the coldest portion of the discharge space; the length of the container along a lengthwise direction is larger than the largest width in a direction perpendicular to the lengthwise direction and the opening is formed at an end of the container along the lengthwise direction. By such a configuration, the surface of the amalgam facing the opening is exposed to a cold condition in the discharge space. Thus, the temperature at the surface of the amalgam facing the opening becomes lower than that inside the amalgam, so that the surface of the amalgam facing the opening is solidified faster than the inside. Thus, the time while the mercury atoms adhering on the surface of the amalgam facing the opening can diffuse into the amalgam is shortened while the amalgam solidifies.

Furthermore, it is preferable that the length of the container is longer than 5 mm and shorter than 15 mm. In such a configuration, the distance from the surface to the bottom of the amalgam in the container is sufficient to prevent the diffusion of the mercury atoms returning from the discharge space evenly while the amalgam is being solidified.

Furthermore, it is preferable that the end of the container where the opening is formed is disposed at a colder side than the other end. With such a configuration, the amalgam in the vicinity of the opening can be solidified faster than the other portion such as inside of the amalgam after switching off of the lamp.

Furthermore, it is preferable that a porous filter having a plurality of through holes is provided in the opening of the container, and the diameter of effective part of each through hole is larger than the diameter of the mercury atom when the area of the through hole is converted to the diameter of a circle having the same area. This configuration is effective where the opening of the container cannot be made enough smaller to serve as a barrier. The porous filter serves as a barrier.

Furthermore, it is preferable that the porous filter is an aggregate of particles selected from zeolite, porous glass and oxide. By such a configuration, further to the effect of the porous filter, the particles serve as pseudo-cores for preventing the supercooling of the amalgam. Thus, the amalgam can be changed from the liquid phase to the solid phase easily.

In the above-mentioned configurations, it is preferable that the container be made of glass material. By such a configuration, the container can be formed in a desired shape such as a waterdrop shape. The productivity of the container can be increased and the cost of the container can be reduced.

Alternatively, in the above-mentioned low pressure mercury vapor filled discharge lamp of this invention, it is preferable that the barrier member be a container having a plurality of openings dispersedly provided therein, and the diameter of effective part of each opening is larger than the diameter of the mercury atom when the area of the opening is converted to a diameter of a circular having the same area but the total area of the openings is smaller than about 0.2 $mm^2$. By such a configuration, the mercury atoms returning to the amalgam are concentrated at predetermined portions of the surface of the amalgam by the openings of the container. Thus, the returning speed of the mercury atoms to the amalgam becomes slower. In the meantime, the temperature of the lamp becomes lower than the solidification temperature of the amalgam before the mercury atoms in the discharge space return to the amalgam. Consequently, a lot of mercury atoms remain in the discharge space.

Furthermore, it is preferable that the container be made of a porous glass material. By such a configuration, the through holes of the porous glass serve as the openings. The particles of the glass serve as pseudo-cores for preventing the supercooling of the amalgam. Thus, the amalgam can be changed from the liquid phase to the solid phase easily.

Alternatively, in the above-mentioned low pressure mercury vapor filled discharge lamp of this invention, it is preferable that the barrier member be made of an aggregation of particles coated on a surface of the amalgam and having a plurality of through holes, the diameter of effective part of each through hole being larger than the diameter of the mercury atom when the area of the through hole is converted to the diameter of a circle having the same area but the total area of the through holes is smaller than about 0.2 $mm^2$. By such a configuration, the mercury atoms returning to the amalgam are concentrated at portions of the surface of the amalgam in the vicinity of the through holes of the barrier member. Thus, the returning speed of the mercury atoms to the amalgam becomes slower. In the meantime, the temperature of the lamp becomes lower than the solidification temperature of the amalgam before the mercury atoms in the discharge space return to the amalgam. Consequently, a lot of mercury atoms remain in the discharge space.

Furthermore, it is preferable that the aggregation of particles is selected from oxide, zeolite, talc and glass particles. Especially, the oxide is selected from titanium oxide, aluminum oxide, silicon oxide, magnesium oxide and rare earth metal oxide. In such a configuration, the particles serve as pseudo-cores for preventing the supercooling of the amalgam. Thus, the amalgam can be changed from the liquid phase to the solid phase easily.

In the above-mentioned configurations, it is preferable that a pair of electrodes be provided on both ends of the vessel, and the amalgam is provided in the vicinity of at least one of the pair of electrodes. By such a configuration, a compact self-ballasted fluorescent lamp with globe shaped cover, in which the amalgam functions in accordance with the temperature in the vicinity of the electrode for controlling the mercury vapor pressure in the discharge space, can be obtained.

Alternatively, it is preferable that an electro-magnetic energy supplying device is provided from outside of the vessel, and the amalgam is provided at a portion in the discharge space where the magnetic energy is supplied. In such a configuration, an electrodeless fluorescent lamp, in which the amalgam is caused to function by the temperature produced by the electromagnetic energy supplied from the outside of the vessel for controlling the mercury vapor pressure in the discharge space, can be obtained.

In the above-mentioned configurations, it is preferable that the base material of the amalgam includes at least one selected from bismuth, indium, tin, zinc and silver. In such a configuration, the temperature at which the amalgam functions can freely be set by selection of one or combination of these materials.

In the above-mentioned configurations, it is preferable that the vessel be one selected from the group of a multiply bent tube, a circularly bent tube, a straight tube and a bulb. By such a configuration, the amalgam system of this invention can be applied in all types of fluorescent lamps on the market.

DETAILED DESCRIPTION OF THE INVENTION

FIRST EMBODIMENT

Figure 1:
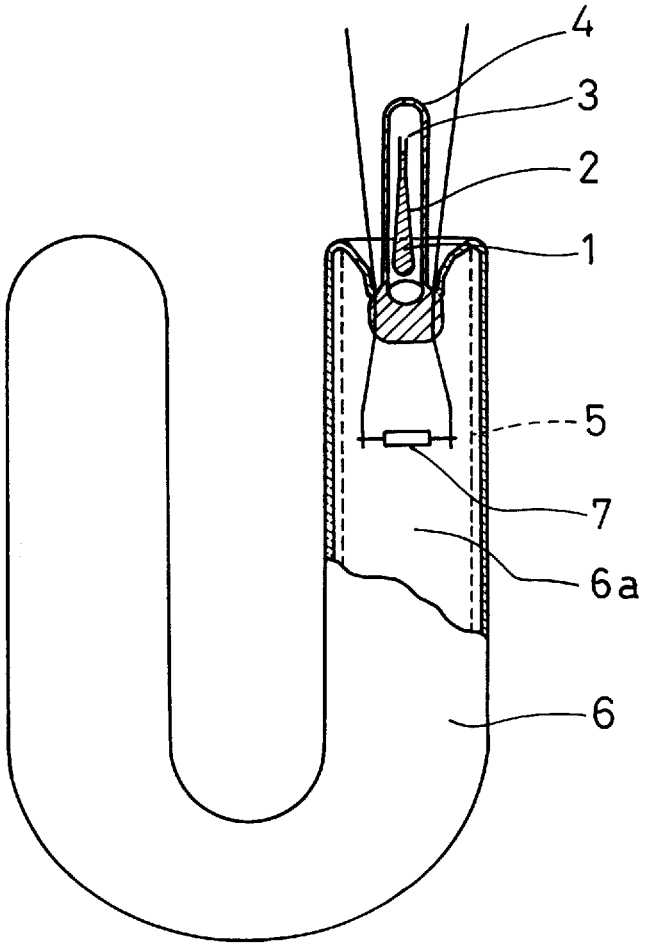
FIG. 1 is a partially cut-away cross-sectional side view showing a configuration of a multi-U-bent tube of a compact self-ballasted fluorescent lamp according to a first embodiment of a low pressure mercury vapor filled discharge lamp of this invention.
Figure 2A:
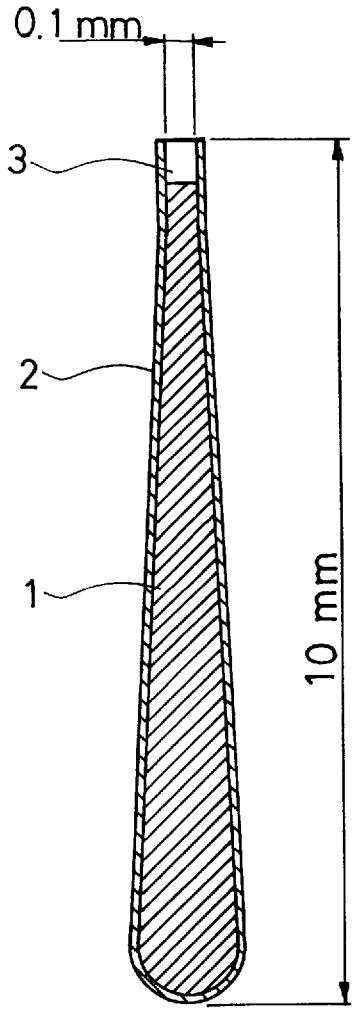
FIGS. 2A, 2B and 2C are respectively enlarged cross-sectional views showing detailed configuration of a container 2 containing an amalgam 1 in the multi-U-bent tube 6 shown in FIG. 1.
Figure 6:
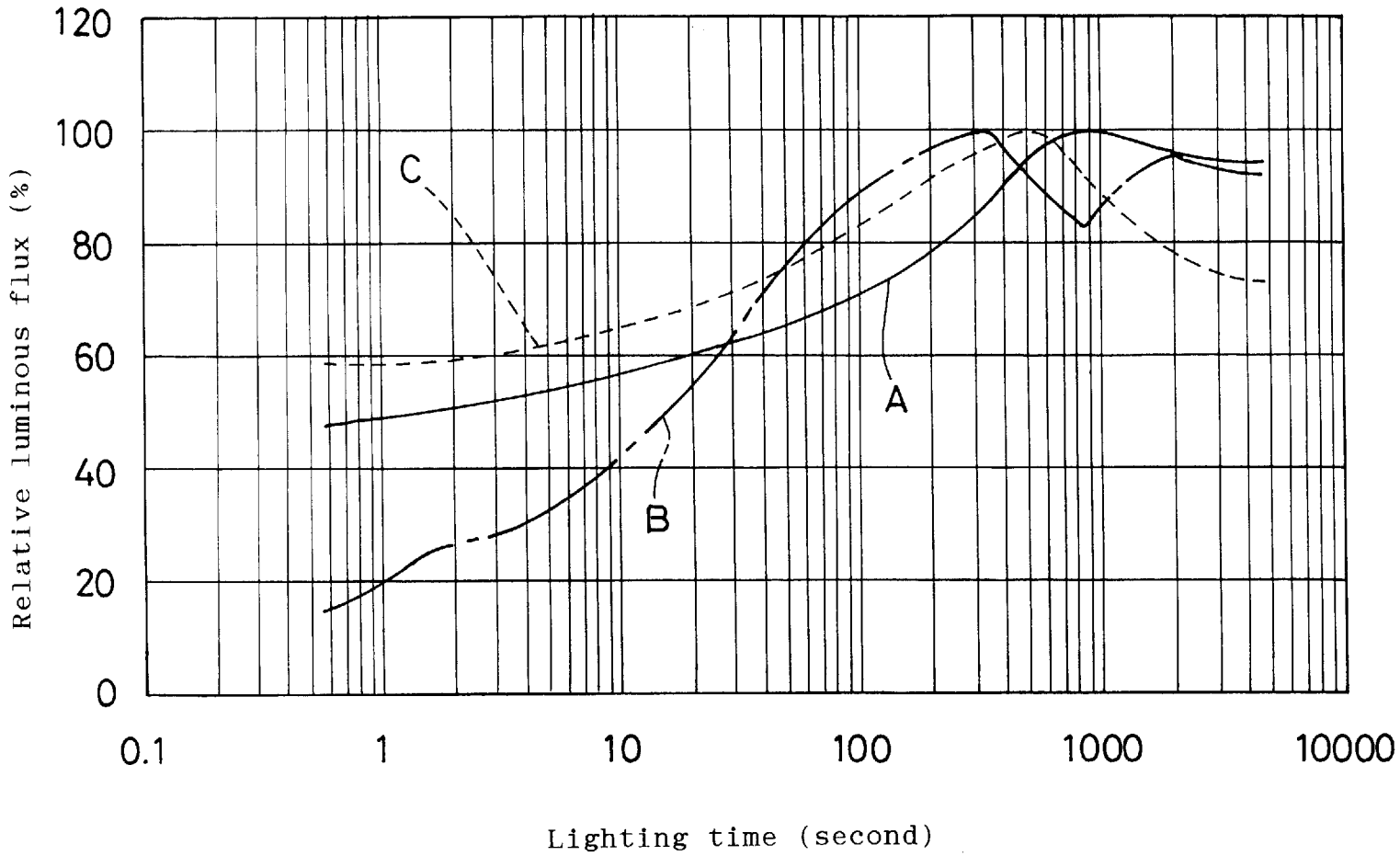
FIG. 6 is a characteristic graph showing the relation between luminance and time from of the beginning of the lighting of the compact self-ballasted fluorescent lamp of the first embodiment, the first conventional compact self-ballasted fluorescent lamp and a reference compact self-ballasted fluorescent lamp.

A first preferred embodiment of the low pressure mercury vapor filled discharge lamp of this invention is described referring to FIGS. 1, 2A and 6. The first embodiment relates to a compact self-ballasted fluorescent lamp having, for example, a multi-U-bent tube (hereinafter, abbreviated as fluorescent lamp). As can be seen from FIG. 1, the fluorescent lamp of the first embodiment includes a multi-U-bent tube (glass vessel) 6, a pair of electrodes (filaments) 7 (one electrode is shown in the figure) and narrow tubes 4 which are provided on both ends of the tube 6. A fluorescent layer 5 is formed on an inner surface of the tube 6. A container 2, which is, for example, made of glass, is disposed in each narrow tube 4. Amalgam 1 comprises a base material of an alloy of bismuth and indium with 3% of weight of mercury included in the base material. The amalgam 1 is contained in the container 2.

The container 2 serves as a barrier for restricting the movement of mercury atoms between the amalgam 1 and a discharge space 6*a* inside the tube 6. In other words, the barrier reduces the degree of movement of the mercury atoms. As can be seen from FIG. 2A, an inside wall of the container 2 fits the amalgam 1 for shielding the amalgam 1 from the discharge space 6*a*. The container 2 has a rotationally symmetrical waterdrop shape. The length of the container 2 in an axial direction (or a lengthwise direction) is about 10 mm, and the diameter of opening 3 at an end of the container 2 is about 0.1 mm. However, the size of the opening 3 is not restricted by this numerical example. It is preferable that the diameter of effective part the opening 3 is larger than the diameter of the mercury atom but smaller than 0.5 mm when the opening 3 of the container 2 is converted to the diameter of a circle of the same area. The container 2 is disposed in the narrow tube 4 in a manner so that the opening 3 is disposed at a lower temperature side far from the electrode 7. Generally, the inside of the narrow tube 4 is the coldest portion in the discharge space 6*a* while the lamp has been lighted. The area of the opening 3 enables the mercury atoms to be supplied from the amalgam 1 to the discharge space 6*a* while the fluorescent lamp is being lighted, but prevents to return the mercury atoms from the discharge space 6*a* to the amalgam 1 while the amalgam 1 has solidified after the fluorescent lamp is switched off.

The principle of this invention is described below. The mercury atoms, which exist in the discharge space 6*a* ar a preferable vapor pressure while the fluorescent lamp is being lighted, start to return to the amalgam 1 corresponding to the reduction of the temperature after switching off of the fluorescent lamp. However, the amalgam 1 in the container 2 is exposed to the discharge space 6*a* only at the opening 3. As mentioned above, the area of the opening 3 is very small. The degree of movement of the mercury atoms is very small, so that the amalgam 1 has solidified before a lot of mercury atoms return to the amalgam 1. Thus, the diffusing speed of the mercury atoms into the amalgam becomes very slow. After solidification of the amalgam 1, the mercury atoms adhere on only the minute surface of the amalgam 1 at the opening 3. Furthermore, the density of the mercury atoms at the boundary between the amalgam 1 and the discharge space 6*a* becomes much higher than that in the other part, so that the mercury vapor pressure in the vicinity of the boundary increases. Thus, the reduction of the mercury atoms in the discharge space 6*a* can be reduced. Consequently, the luminance of the fluorescent lamp of the first embodiment can be increased at the beginning of re-lighting of the lamp.

Figure 8:
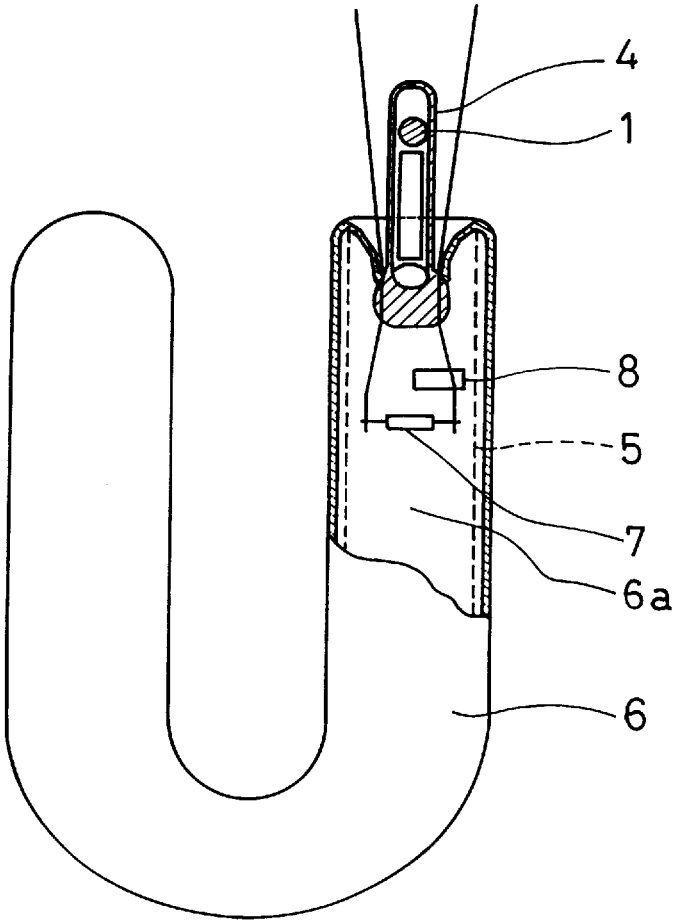
FIG. 8 is a partially cut-away cross-sectional side view showing the configuration of the first type of conventional compact self-ballasted fluorescent lamp.
Figure 9:
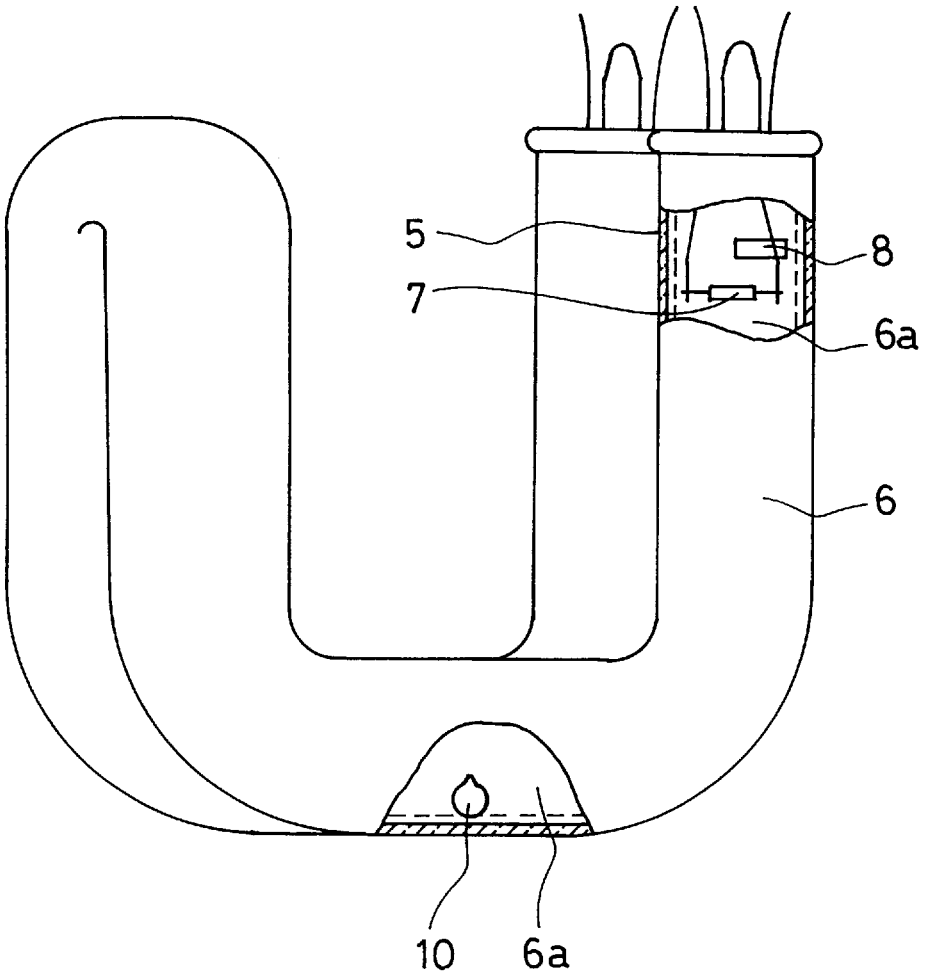
FIG. 9 is a partially cut-away cross-sectional side view showing the configuration of the second type of conventional compact self-ballasted fluorescent lamp.
Figure 10:
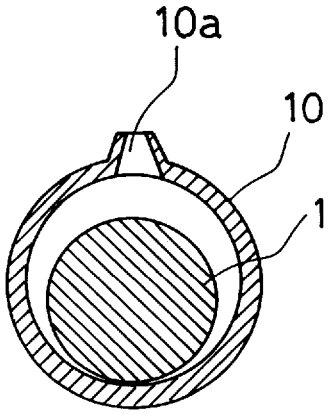
FIG. 10 is an enlarged cross-sectional side view showing the detailed configuration of the container shown in FIG. 9.

A prototype of the fluorescent lamp of the first embodiment was manufactured and the relative luminous flux of the fluorescent lamp at the beginning of the re-lighting was measured. As comparative examples, the first type of conventional fluorescent lamp shown in FIG. 8 and a reference fluorescent tamp without amalgam and auxiliary amalgam but filled with mercury vapor were prepared. The relative luminous flux of these comparative examples at the beginning of the re-lighting were also measured. The results of the measurements are shown in FIG. 6.

In FIG. 6, the abscissa represents a time from the start of the lighting of the lamps, and the ordinate represents the relative luminous flux (%) of each fluorescent lamp at a time of measurement against the maximum intensity of the luminance of the fluorescent lamp. Characteristic curve "A" represents the relative luminous flux of the fluorescent lamp of the first embodiment of this invention. Characteristic curve "B" represents the relative luminous flux of the conventional fluorescent lamp. Characteristic curve "C" represents the relative luminous flux of the referential fluorescent lamp. Each fluorescent lamp comprises an electronic ballast circuit excluding pre-heating mode of the filament. Each fluorescent lamp was once lighted for several hours. After that, each fluorescent lamp was re-lighted at ambient temperature of 25° C. after fifteen hours had passed after the switching off of the fluorescent lamp.

As can be seen from FIG.6, the characteristic curve "A" according to the fluorescent lamp of the first embodiment of this invention starts from about 50% of the relative luminous flux. On the other hand, the characteristic curve "B" according to the conventional fluorescent lamp starts about 20% of the relative luminous flux, since the mercury vapor pressure due to the main amalgam 1 and the auxiliary amalgam 8 is lower at the beginning of the re-lighting. After the passage of about 1000 seconds, the fluorescent lamp of the first embodiment can maintain substantially the maximum luminous flux. Similarly, after the passage of about 2000 seconds, the conventional fluorescent lamp can maintain substantially the maximum luminous flux. On the contrary, the characteristic curve "C" according to the reference fluorescent lamp starts from about 60% of the relative luminous flux. However, the relative luminous flux of the referential fluorescent lamp decreases after reaching the maximum luminous flux, since the mercury vapor pressure increases to a level above the most preferable pressure after passing the maximum luminous flux.

Next, the reason why the relative intensity of the luminance of the fluorescent lamp of the first embodiment was increased at the beginning of the re-lighting is considered. When the fluorescent lamp of the first embodiment was lighted during the several hours at first, the amalgam 1 in the container 2 was changed to the liquid phase at a temperature about 120 degrees Celsius. Thus, the mercury atoms evenly exist in the amalgam 1, and the mercury is equilibrated between the vapor phase and the liquid phase at the boundary between the amalgam 1 and the discharge space 6*a* at the opening 3 of the container 2. While the fluorescent lamp has been lighted for a long time, the mercury vapor pressure in the discharge space was maintained at substantially the best condition, so that substantially the maximum intensity of the luminance has been obtained. The same amount of the mercury atoms as spent in the discharge space 6*a* of the tube 6 is supplied from the amalgam 1.

When the fluorescent lamp of the first embodiment is switched off, the mercury atoms will return to the amalgam 1 directly through the opening 3 or return to the amalgam 1 directly through the opening 3 as repeating the cycle between adhering on and releasing from the side wall of the container 2 where the temperature and the mercury vapor pressure are reduced. However, since the diameter of the opening 3 of the container 2 is about 0.1 mm when the opening 3 is converted as circular, the conductance of the movement of the mercury atoms is too small. While the amalgam 1 is in the liquid phase, only a part of the mercury atoms existed in the discharge space can return to the amalgam 1. The mercury atoms adhered on the surface of the amalgam 1 in the liquid phase can easily diffuse into the amalgam 1.

When the amalgam 1 has solidified, the diffusion rate of the mercury atoms into the amalgam 1 suddenly decreases. The mercury atoms reaching after the solidification of the amalgam 1 deposit and adhere on the surface of the amalgam 1. However, the area of the surface of the amalgam 1 exposed to the discharge space 6*a* is small, so that the density of the mercury adhered on the surface of the amalgam 1 suddenly increases. When the mercury vapor pressure in the vicinity of the surface of the amalgam 1 becomes substantially equal to the mercury vapor pressure in the vicinity of the surface of the wall of the container 2, the movement of the mercury atoms stops. At this time, most of the mercury atoms existing in the discharge space 6*a* during the lighting of the fluorescent lamp continue to exist in the discharge space 6*a* including the wall of the container 2. By the above-mentioned processes, the relative luminous flux of the fluorescent lamp of the first embodiment at the beginning of the re-lighting of the fluorescent lamp can be considered to be increased in comparison with that of the conventional fluorescent lamp.

As shown in FIG. 2A, the above-mentioned first embodiment is explained referring to the numerical example that the diameter of the opening 3 of the container 2 is about 0.1 mm when the area of the opening 3 is converted to the diameter of a circle of the same area. However, the smaller the size of the opening 3 of the container 2 is, the larger the amount of the mercury atoms which can remain in the discharge space 6*a*. Thus, the relative luminous flux at the beginning of the re-lighting of the lamp can be increased. Alternatively, when the diameter of the opening 3 of the container 2 is about 0.5 mm when the opening 3 is converted to the diameter of a circle of the same area, the relative luminous flux at the beginning of the re-lighting of the fluorescent lamp can be made higher than that of the conventional fluorescent lamp. In the former case, the manufacture of the container 2 becomes difficult and the cost will be increased, but the relative luminous flux of the fluorescent lamp at the beginning of the re-lighting becomes much higher than the conventional fluorescent lamp. On the contrary, in the latter case, the container 2 can be manufactured relatively easier, but the relative luminous flux of the fluorescent lamp at the beginning of the re-fighting is relatively lower than the former case. The choice between the two is based on the purpose and cost performance of the fluorescent lamp.

Figure 2B:
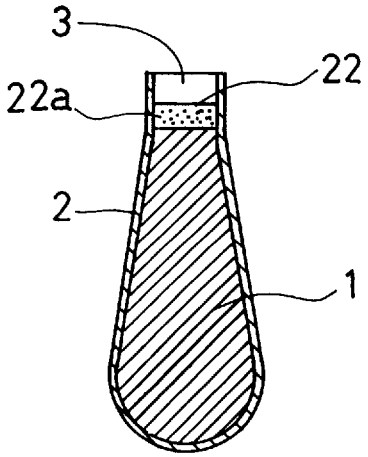

Alternatively, as shown in FIG. 2B, it is preferable to provide a porous filter 22 having a plurality of through holes 22*a* to contact the surface of the amalgam 1 except for the through holes 22*a* in the opening 3 of the container 2. Each through hole 22*a* of the porous filter 22 has an effective diameter larger than the diameter of the mercury atom when the through holes 22*a* are converted to the diameter of a circle of the same area. The material of the porous filter 22 is selected from zeolite, porous glass and oxide particle such as titanium oxide, aluminum oxide, silicon oxide, magnesium oxide or rare earth metal oxide. With such a configuration, the area of the opening 3 of the container 2 can be reduced, so that the conductance of the movement of the mercury atoms after switching off of the fluorescent lamp can be reduced. Especially, it is effective when the opening 3 of the container 2 cannot easily be made smaller.

Furthermore, the porous filter 22 is disposed to contact the surface of the amalgam 1, so that the particles of the porous filter 22 serve as pseudo-cores for preventing supercooling of the amalgam 1. Consequently, the change of the amalgam 1 from the liquid phase to the solid phase can be made easier (see the publication gazette of unexamined Japanese patent application Sho 63-284748. These functions of the porous filter 22 are effective to maintain the amount of the mercury atoms which are to remain in the discharge space, and to increase the relative luminous flux of the fluorescent lamp at the beginning of the re-lighting.

Figure 2C:
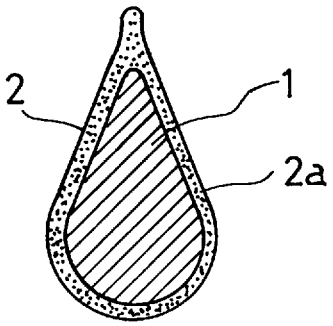

Alternatively, as shown in FIG. 2C, it is preferable that the container 2 be made of porous glass. The container 2 has a plurality of through holes 2*a*, similar to the porous filter 22 shown in FIG. 2B. The through holes 2*a* of the container 2 permit to move the mercury atoms from the amalgam 1 to the discharge space 6*a* in the multi-U-bent tube 6, but restrict to return the mercury atoms from the discharge space 6*a* to the amalgam 1 in a short time while the amalgam 1 solidifies. Thus, when the container 2 is made of porous material, effects which are substantially the same as those of the porous filter 22 shown in FIG. 2B can be obtained.

Furthermore, the base material of the amalgam 1 is not restricted by the above-mentioned example of the alloy of bismuth and indium. It is preferable that an alloy of the base material includes one or more kind of metals selected from bismuth, indium, tin, lead, zinc and silver. By selecting the material of the base material of the amalgam 1, the temperature at which the amalgam changes phase can be selected desirably.

SECOND EMBODIMENT

Figure 3:
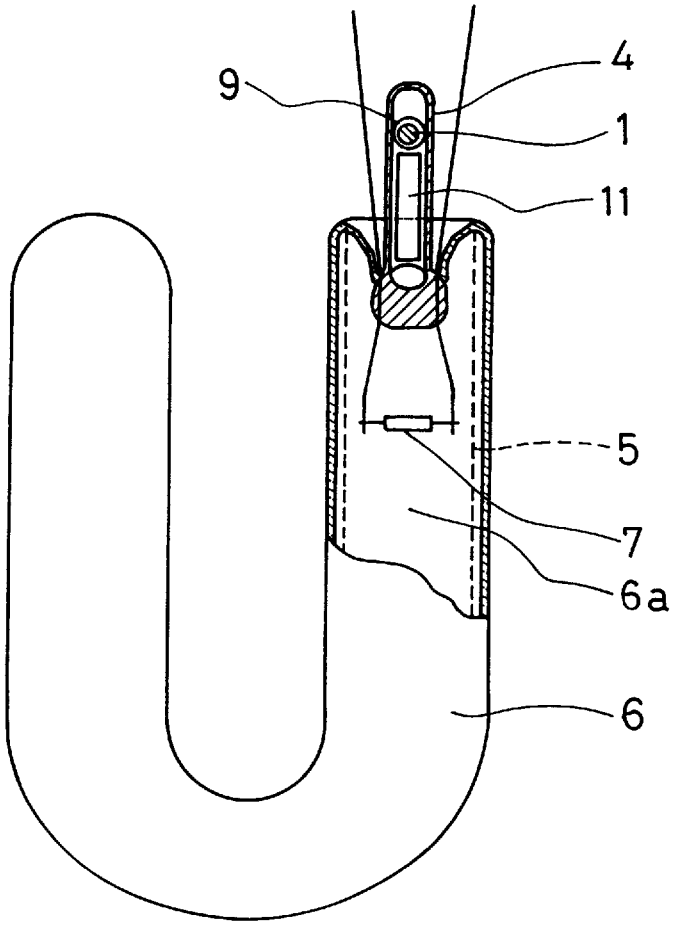
FIG. 3 is a partially cut-away cross-sectional side view showing a configuration of a multi-U-bent tube of a compact self-ballasted fluorescent lamp according to a second embodiment of a low pressure mercury vapor filled discharge lamp of this invention.
Figure 4:
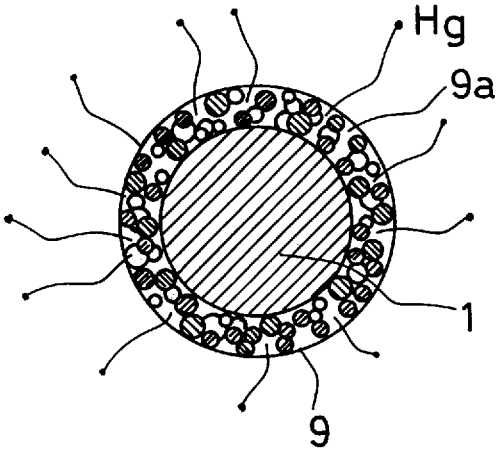
FIG. 4 is an enlarged cross-sectional view showing detailed configuration of an amalgam and an aggregate of particles adhered thereon of the multi-U-bent tube shown in FIG. 3.
Figure 7:
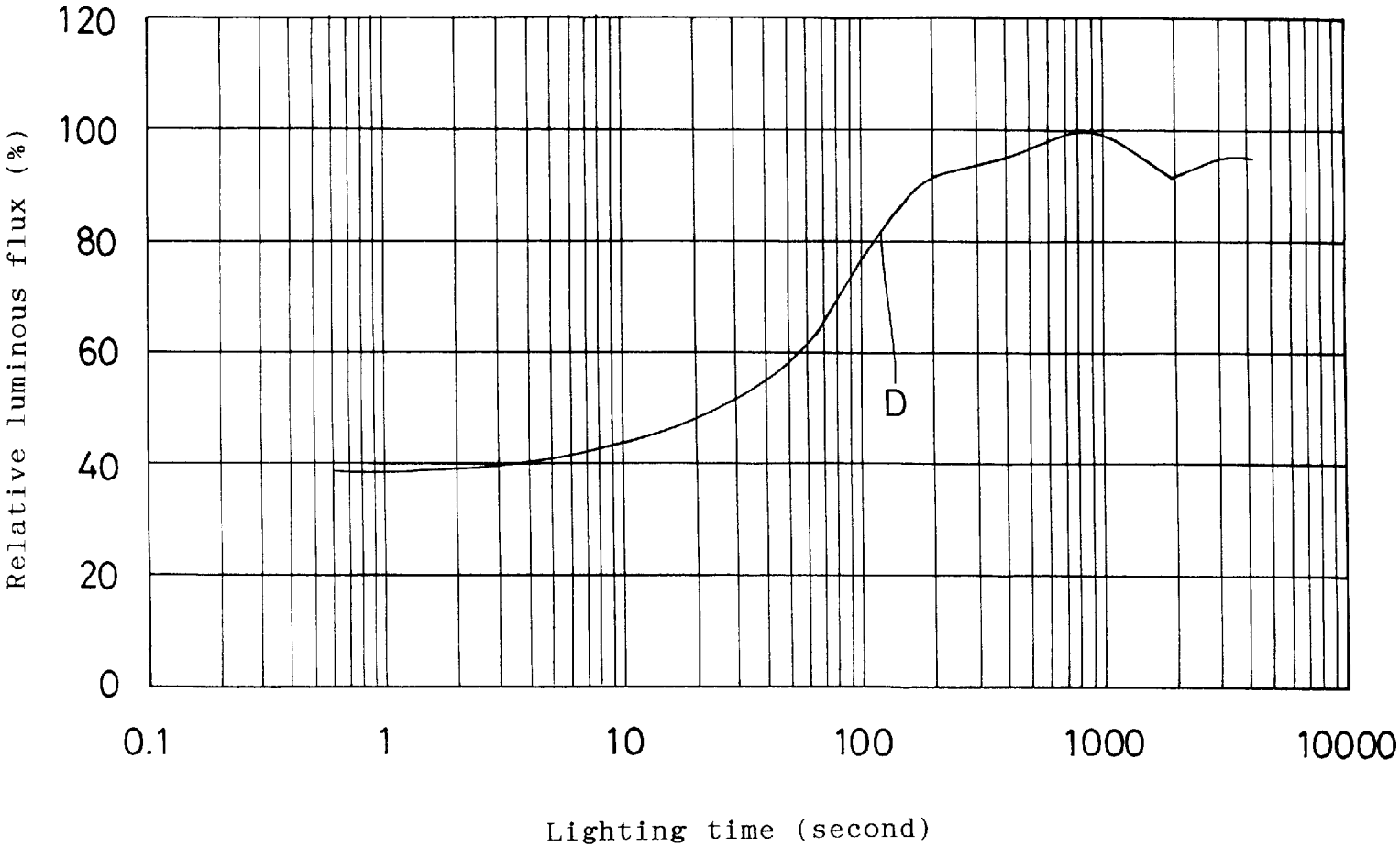
FIG. 7 is a characteristic graph showing the relation between luminance and time from of the beginning of the lighting of the compact self-ballasted fluorescent lamp of the second embodiment.

A second preferred embodiment of the low pressure mercury vapor filled discharge lamp of this invention is described referring to FIGS. 3, 4 and 7. The second embodiment relates to a compact self-ballasted fluorescent lamp with a multi-U-bent tube (hereinafter, abbreviated as fluorescent lamp). As can be seen from FIG. 3, the fluorescent lamp of the second embodiment comprises a multi-U-bent tube 6, a pair of electrodes 7 (one electrode is shown in the figure) and narrow tubes 4 which are provided on both ends of the tube 6. A fluorescent layer 5 is formed on an inner surface of the tube 6. A glass rod 11 and an amalgam 1 are disposed in series in the narrow tube 4 from the electrode 7. Amalgam 1 consists of a base material of an alloy of bismuth and indium and about 3 wt % mercury included in the base material. The amalgam 1 has substantially a ball shape.

As can be seen from FIGS. 3 and 4, an aggregation of particles 9 is coated on the surface of the amalgam 1. The aggregation of the particles 9 serves as a barrier for restricting the movement of the mercury atoms between the amalgam I and the discharge space 6*a* inside the tube 6 corresponding to switching on and off the fluorescent lamp. The aggregation of the particles 9 is, for example, is formed by spreading a suspension of talc dispersed in volatile solvent on the surface of the amalgam 1. An average particle diameter of the aggregation of particles 9 is about 0.1 $\mu$m and the quantity of the adhered particles is about 1 mg/cm$^2$. The aggregation of particles 9 has a plurality of through holes 9*a* dispersedly formed. An effective diameter of each through hole 9*a* is Larger than the diameter of a mercury atom when the through hole 9*a* is converted to the diameter of a circle of the same area but the total area of the through holes 9*a* is smaller than about 0.2 mm$^2$.

A prototype of the fluorescent lamp of the second embodiment was manufactured and the relative luminous flux at the beginning of the re-lighting was measured. The result is shown in FIG. 7. In FIG. 7, the abscissa represents a time from the start of the lighting of the lamps, and the ordinate represents the relative luminous flux (%) of the fluorescent lamp at a time of measurement against the maximum luminous flux of the fluorescent lamp. Characteristic curve "D" represents the relative luminous flux of the fluorescent lamp of the second embodiment of this invention. The fluorescent lamp comprises an electronic ballast circuit excluding pre-heating mode of the filament. The fluorescent lamp was once Lighted for several hours. After that, the fluorescent lamp was re-lighted at ambient temperature of 25° C. after fifteen hours had passed after the switching off of the fluorescent lamp.

As can be seen from FIG. 7, characteristic curve "D" according to the fluorescent lamp of the second embodiment of this invention starts from about 40% of the relative luminous flux. On the other hand, as shown in FIG. 6, characteristic curve "B" according to the conventional fluorescent lamp starts about 20% of the relative luminous flux, since the mercury vapor pressure due to the main amalgam 1 and the auxiliary amalgam 8 is lower at the beginning of the re-lighting. In comparison with the conventional fluorescent lamp, the relative luminous flux at the beginning of the re-lighting of the fluorescent lamp of the second embodiment is increased. Thus, it is found that the aggregation of particles 9 coated on the surface of the amalgam 1 can serve as the barrier for restricting the movement of the mercury atoms between the amalgam 1 and the discharge space 6*a*.

The material of the aggregation particles 9 is not restricted to the above-mentioned example of talc. Instead of talc, one selected from zeolite, glass powder and oxide particles such as titanium oxide, aluminum oxide, silicon oxide, magnesium oxide and rare earth metal oxide can be used.

THIRD EMBODIMENT

Figure 5:
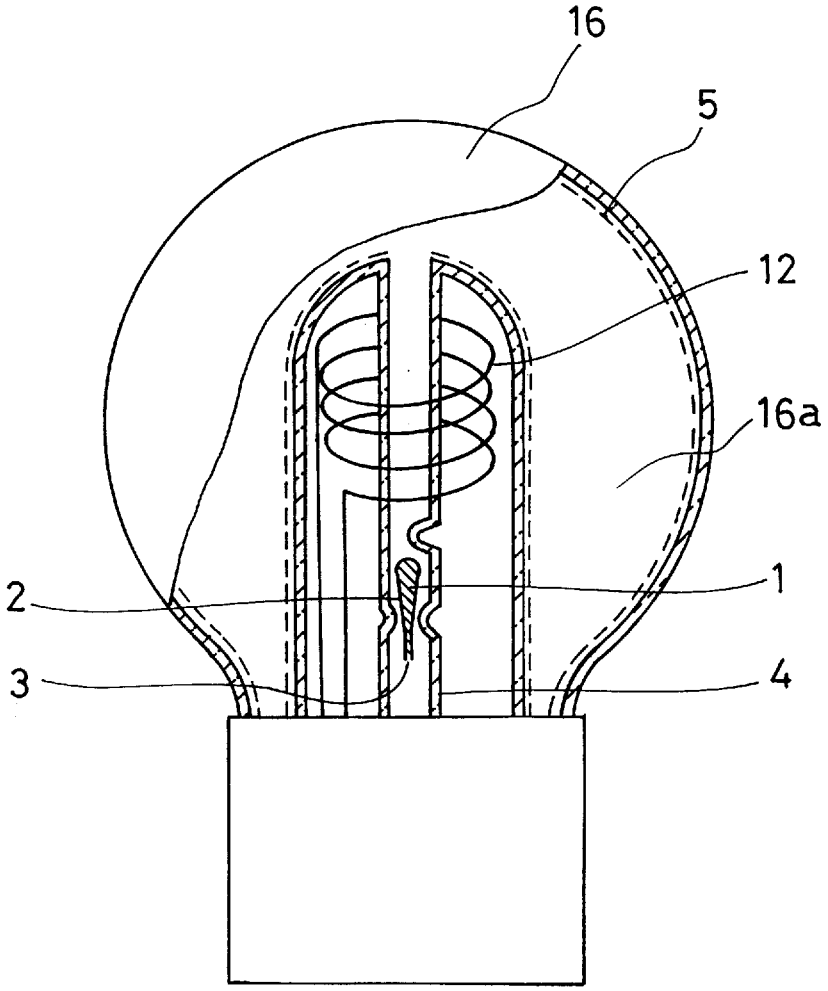
FIG. 5 is a partially cut-away cross-sectional side view showing a configuration of an electrodeless type fluorescent lamp according to a third embodiment of a low pressure mercury vapor filled discharge lamp of this invention.

A third preferred embodiment of the low pressure mercury vapor filled discharge lamp of this invention is described referring to FIG. 5. The third embodiment relates to the electrodeless type fluorescent lamp. As can be seen from FIG. 5, the electrodeless type fluorescent lamp of the third embodiment comprises a bulb (glass vessel) 16, a narrow tube 4 disposed at the center of the bulb 16, and a coil. 12 wound around the outside of the narrow tube 4. A fluorescent layer 5 is formed on an inside face of the bulb 16. The center part of the bulb 16 is hollow, and the narrow tube 4 is connected to an inner discharge space 16*a* of the bulb 16. Thus, the discharge space 16*a* inside the bulb 16 can be considered as multiply bent. The coil 12 supplies electromagnetic energy into the discharge space 16*a*. Container 2, which is, for example, made of glass, is disposed inside the narrow tube 4. Amalgam 1 consisting of a base material of an alloy of bismuth and indium and about 3 wt % mercury included in the base material is contained in the container 2.

The container 2 serves as a barrier for restricting the movement of mercury atoms between the amalgam 1 and the inner discharge space 16*a* of the bulb 16. In other wards, the barrier reduces the degree of movement of the mercury atoms. Similar to the first embodiment shown in FIG. 2, an inside wall of the container 2 fits the amalgam 1 for shielding the amalgam 1 from the discharge space 16*a*. The container 2 has a rotationally symmetrical waterdrop shape. A length of the container 2 in an axial direction (or a lengthwise direction) is about 10 mm, and the diameter of opening 3 at an end of the container 2 is about 0.1 mm. However, the size of the opening 3 is not restricted by this example. The container 2 is disposed in the narrow tube 4 in a manner so that the opening 3 is disposed at a lower temperature side far from the coil 12.

The third embodiment is described referring to the example of the amalgam 1 contained in the container 2 similar to the first embodiment. However, the amalgam 1 is not restricted by this example. It is preferable that the an aggregation of particles of oxide is coated on the surface of the amalgam similar to the second embodiment. Alternatively, it is preferable that the container 2 is made of porous glass. Alternatively, a porous fitter can be disposed at the opening 3 of the container 2.

The operations of the amalgam 1 and the container 2 serving as a barrier are the same as those in the above-mentioned first embodiment. Thus, the explanations of them are omitted.

Furthermore, the above-mentioned embodiments of the low pressure mercury vapor filled discharge lamp are explained referring to multi-U-bent type tube or bulb. However, the amalgam system of this invention, in which the barrier means is provided to contact the surface of the amalgam for shielding the amalgam 1 from the discharge space except for the opening or through holes, is effective to a straight fluorescent lamp and a circular fluorescent lamp.

The invention may be embodied in other specific forms without departing from the spirit and scope thereof. The embodiments are to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A low pressure mercury vapor filled discharge lamp comprising: a vessel having a fluorescent layer coated on an inner surface thereof; an amalgam including mercury as a primary amalgam disposed at a predetermined position in a discharge space formed inside the vessel; and barrier means for restricting movement of mercury atoms between the amalgam and the discharge space corresponding to switching on and off of the lamp;

wherein the vessel contains no amalgam other than said primary amalgam and the barrier means is provided to contact the amalgam for shielding the amalgam from the discharge space except for at least one opening, and the opening of the barrier means permits supply of the mercury atoms from the amalgam to the discharge space while the lamp is lighted and restricts return of mercury atoms from the discharge space to the amalgam after switching off of the lamp;

the barrier means comprising a container having a rotationally symmetrical waterdrop shape such that the length of the container along its lengthwise direction is greater than a largest width in a direction perpendicular to said lengthwise direction and having only one opening formed at an end of the container along the lengthwise direction, the opening having an effective diameter larger than the diameter of a mercury atom but smaller than 0.5 mm when the opening is converted to the diameter of a circle having the same area as the opening, and an inside wall of the container fits a surface of said amalgam for shielding the amalgam from the discharge space and a portion of the amalgam that directly contacts with the discharge space is exposed at the opening of the container.

2. The low pressure mercury vapor filled discharge lamp according to claim 1, wherein a pair of electrodes is provided on both ends of the vessel, and the amalgam is provided in the vicinity of at least one of the pair of electrodes.

3. The low pressure mercury vapor filled discharge lamp according to claim 1, wherein an electro-magnetic energy supplying device is provided from outside the vessel, and the amalgam is provided at a portion in the discharge space where the electro-magnetic energy is supplied.

4. The low pressure mercury vapor filled discharge lamp according to claim 1, wherein the container is disposed in the vicinity of the coldest portion of the discharge space; the length of the container along a lengthwise direction is larger than the largest width in a direction perpendicular to the lengthwise direction; and the opening is formed at an end of the container along the lengthwise direction.

5. The low pressure mercury vapor filled discharge lamp according to claim 1, wherein the length of the container of the tube shape along the axis is longer than 5 mm and shorter than 15 mm.

6. The low pressure mercury vapor filled discharge lamp according to claim 1, wherein the end of the container where the opening is formed is disposed at a colder side than the other end.

7. The low pressure mercury vapor filled discharge lamp according to claim 1, wherein the container is made of a glass material.

8. The low pressure mercury vapor filled discharge lamp according to claim 1, wherein a pair of electrodes is provided on each of the ends of the vessel, and the amalgam is provided in the vicinity of at least one of the pair of electrodes.

9. The low pressure mercury vapor filled discharge lamp according to claim 1, wherein an electro-magnetic energy supplying device is provided from outside the vessel, and the amalgam is provided at a portion in the discharge space where the electro-magnetic energy is supplied.

10. The low pressure mercury vapor filled discharge lamp according to claim 1, wherein base material of the amalgam is at least one element selected from the group consisting of bismuth, indium, tin, zinc and silver.

11. The low pressure mercury vapor filled discharge lamp according to claim 1, wherein a porous filter having a plurality of through holes is provided in the opening of the container, and an effective diameter of each through hole is larger that the diameter of a mercury atom when the through hole is converted to the diameter of a circle of the same area.

12. The low pressure mercury vapor filled discharge lamp according to claim 11, wherein the porous filter is an aggregate of particles selected from the group consisting of zeolite, porous glass and oxide particles.

13. The low pressure mercury vapor filled discharge lamp according to claim 11, wherein the container is made of a glass material.

14. The low pressure mercury vapor filled discharge lamp according to claim 11, wherein a pair of electrodes is provided on each of the ends of the vessel, and the amalgam is provided in the vicinity of at least one of the pair of electrodes.

15. The low pressure mercury vapor filled discharge lamp according to claim 11, wherein an electro-magnetic energy supplying device is provided from outside the vessel, and the amalgam is provided at a portion in the discharge space where the electro-magnetic energy is supplied.

16. The low pressure mercury vapor filled discharge lamp according to claim 1, wherein the barrier means is a container having a plurality of openings dispersedly provided, and an effective diameter of each opening is larger than the diameter of a mercury atom when the opening is converted to the diameter of a circle of the same area but the total area of the openings is smaller than about 0.2 $mm^2$.

17. The low pressure mercury vapor filled discharge lamp according to claim 16, wherein the container is made of a porous glass material.

18. The low pressure mercury vapor filled discharge lamp according to claim 16, wherein a pair of electrodes is provided on both ends of the vessel, and the amalgam is provided in the vicinity of at least one of the pair of electrodes.

19. The low pressure mercury vapor filled discharge lamp according to claim 16, wherein an electro-magnetic energy supplying device is provided from outside the vessel, and the amalgam is provided at a portion in the discharge space where the electro-magnetic energy is supplied.

20. The low pressure mercury vapor filled discharge lamp according to claim 1, wherein the barrier means is made of an aggregation of particles coated on a surface of the amalgam, an effective diameter of each through hole is larger than the diameter of a mercury atom when the through hole is converted to the diameter of a circle of the same area but the total area of the through holes is smaller than about 0.2 $mm^2$.

21. The low pressure mercury vapor filled discharge lamp according to claim 20, wherein the aggregation of particles is selected from the group consisting of oxide, zeolite, talc and glass particles.

22. The low pressure mercury vapor filled discharge lamp according to claim 21, wherein the oxide is selected from the group consisting of titanium oxide, aluminum oxide, silicon oxide, magnesium oxide and rare earth metal oxide.

23. The low pressure mercury vapor filled discharge lamp according to claim 20, wherein a pair of electrodes is provided on each of the ends of the vessel, and the amalgam is provided in the vicinity of at least one of the pair of electrodes.

24. The low pressure mercury vapor filled discharge lamp according to claim 20, wherein an electro-magnetic energy supplying device is provided from outside the vessel, and the amalgam is provided at a portion in the discharge space where the electro-magnetic energy is supplied.

25. The low pressure mercury vapor filled discharge lamp according to claim 20, wherein base material of the amalgam is at least one element selected from the group consisting of bismuth, indium, tin, zinc and silver.

26. The low pressure mercury vapor filled discharge lamp according to claim 1, wherein the vessel be one selected from the group of a multiply bent tube, a circularly bent tube, a straight tube and a bulb.

* * * * *